US006211895B1

(12) United States Patent
Asabe et al.

(10) Patent No.: US 6,211,895 B1
(45) Date of Patent: Apr. 3, 2001

(54) INK RIBBON ASSEMBLY, AND THERMAL TRANSFER PRINTER USING THE SAME

(75) Inventors: Yoshiyuki Asabe; Hiroshi Sato; Eihin Setsu, all of Tokyo; Iwao Nozaki, Wakayama, all of (JP)

(73) Assignees: Alps Electric Co., Ltd., Tokyo; Noritsu Koki Co., Ltd., Wakayama; Olympus Optical Co., Ltd., Tokyo, all of (JP)

( * ) Notice: Subject to any disclaimer, the term of this patent is extended or adjusted under 35 U.S.C. 154(b) by 0 days.

(21) Appl. No.: 09/334,717

(22) Filed: Jun. 16, 1999

(30) Foreign Application Priority Data

Jun. 16, 1998 (JP) ..... 10-168626
Apr. 14, 1999 (JP) ..... 11-106723

(51) Int. Cl.[7] ..... B41J 33/36
(52) U.S. Cl. ..... 347/212; 347/214
(58) Field of Search ..... 400/206, 206.3, 400/120.18, 240, 244; 347/172, 176, 174, 212–213, 214, 171

(56) References Cited

U.S. PATENT DOCUMENTS 5,863,138 * 1/1999 Watanabe et al. ..... 400/208

FOREIGN PATENT DOCUMENTS 2314042 12/1997 (GB) .
62-173279 7/1987 (JP) .
03047782 2/1991 (JP) .
08300782 11/1996 (JP) .
09202026 8/1997 (JP) .
11048591 2/1999 (JP) .

* cited by examiner

*Primary Examiner*—N. Le
*Assistant Examiner*—K. Feggins
(74) *Attorney, Agent, or Firm*—Koda & Androlia

(57) ABSTRACT

An ink ribbon assembly for use in a thermal transfer printer includes a plurality of ink ribbons 17*a*, 17*b* and 17*c* which has at least one ink ribbon 17*c* less influence on an outcome the printing accuracy is shorter in length than the other ink ribbons 17*a* and 17*b*. The shorter ink ribbon has a terminal end mark 60 formed at its terminal end. At the time point when the end of the shorter ink ribbon is detected in the middle of the printing of one printing area, the other ink ribbons have finished the printing of such printing area, because they are longer than the ink ribbon 17*c*, and thus, joints cannot be produced in the printing with the longer ink ribbons.

11 Claims, 5 Drawing Sheets

INK RIBBON ASSEMBLY, AND THERMAL TRANSFER PRINTER USING THE SAME

FIELD OF THE INVENTION

The present invention relates to an ink ribbon assembly comprising a plurality of ink ribbons, and to a thermal transfer printer using such ink ribbon assembly. Particularly, the present invention relates to an ink ribbon assembly and a thermal transfer printer using the ink ribbon assembly, suitable to lap-print an image with a color ink on a foundation or undercoat already printed, and print an overcoat on the printed image with a clear ink.

DESCRIPTION OF THE RELATED ART

The thermal transfer printer is conventionally used in a wider field for output units such as a computer, a word processor and the like by reasons of a higher printing quality, a lower noise, a lower cost and an easy maintenance.

In such a thermal transfer printer, when the surface of a printing paper sheet is not smooth, or is coated, the following disadvantage is arisen: a portion of an ink is not deposited on the printing paper sheet, or the ink transferred on the printing paper sheet is peeled off by rubbing. For this reason, a distinct result of printing is not obtained.

Therefore, a printing process has been proposed which comprises printing a foundation or undercoat with a clear ink or a white ink for the purpose of previously smoothening the surface of a paper sheet, or treating the surface of a paper sheet to provide a state in which the ink is easily transferred, prior to the printing of an image with an ink of a predetermined color; lap-printing the image on the undercoat with the ink of a predetermined color; and further conducting a lap-printing on an upper surface of the printed image with a clear ink in order to improve the slidability.

Thermal transfer printers using such a printing process which have been proposed, include a so-called auto-changed type thermal transfer printer including a plurality of ribbon cassettes which have ink ribbons (each of which is one of ink films) accommodated therein and retained at a location opposed to a carriage, so that a desired ribbon cassette is selectively replaced automatically by another one depending on the printing, whereby the printing is carried out.

In the above-described thermal transfer printer, however, when a terminal end mark on an ink ribbon is detected in the middle of the printing of an image in printing a code such as a bar code, thereby recognizing the using-up of the ink ribbon, the ribbon cassette having such ink ribbon accommodated therein is replaced by a new ribbon cassette, thereby continuing the printing. However, gaps or lapped portions on the order of 0.05 to 0.2 mm may be produced in some times in the printing before and after the replacement of the ribbon cassette due to the accuracy of detection of a home position of the carriage upon the replacement of the ribbon cassette. When such shear in printing is produced, a disadvantage of generation of a code-reading error is arisen.

In contrast to the printing of the image, the printing of the undercoat is intended to improve the printing of the image, and the overlap printing of an overcoat is intended to protect the code which is the printed image. Even when the ribbon cassette is replaced by new one for ensuring a distinct color tone in accordance with to the detection of a terminal end in the middle of the printing, whereby the link portion in the printing of the undercoat or the overlap printing is displaced, it cannot lead to a code-reading error.

SUMMARY OF THE INVENTION

Accordingly, it is an object of the present invention to provide an ink ribbon assembly and a thermal transfer printer using such an ink ribbon, wherein the printing of the image with the predetermined-color ink is feasible necessarily to the terminal end of a printing area, so that the ink ribbon does not reach its end in the middle of the printing.

To achieve the above object, according to a first aspect and feature of the present invention, there is provided an ink ribbon assembly for use in a thermal transfer printer which uses a plurality of ink ribbons and conducts lap-printings by using the ink ribbons in a predetermined order, wherein at least one ink ribbon less influencing the printing accuracy is shorter in length than the other ink ribbons, the shorter ink ribbon having a terminal end mark formed at its terminal end.

With such feature, at a time point when the end of the shorter ink ribbon is detected in the middle of the printing of one printing area, the other ink ribbons have finished the printing of the printing area, because they are longer in length than the at least one shorter ink ribbon, and hence, joints cannot be produced in the printing carried out by the longer ink ribbons.

According to a second aspect and feature of the present invention, in addition to the first feature, the shorter ink ribbon is an ink ribbon for use in the printing of an uppermost layer. According to a third aspect and feature of the present invention, in addition to the second feature, the ink ribbon for use in the printing of the uppermost layer is an ink ribbon for an overcoat having a clear ink. With the above features, when the ribbon end is detected in the middle of the printing of one printing area and the ink ribbon is replaced by new one to conduct the printing, any problem is not arisen, even if a gap or a joint such as an overlapped portion is produced between the printing area printed with the unreplaced ink ribbon and the printing area printed with the new ink ribbon.

According to a fourth aspect and feature of the present invention, in addition to the first feature, the shorter ink ribbon is an ink ribbon for use in the printing of a lowermost layer. With such feature, the lowermost layer less influences the printing accuracy. Therefore, when the ribbon end is detected in the middle of the printing of one printing area and the ink ribbon is replaced by new one to conduct the printing, the printing is feasible, even if a gap or a joint such as an overlapped portion is produced between the printing area printed with the unreplaced ink ribbon and the printing area printed with the new ink ribbon. To ensure the printing of the voice code to be superposed thereon, the overlapped portion may be provided rather than provision of the gap at the joint. In this case, it is particularly preferable that the length of the overlapped portion is on the order of 1 mm.

According to a fifth aspect and feature of the present invention, in addition to any of the first to fourth features, the shorter ink ribbon is shorter in length than the other ink ribbons by a length required to print at least one printing area. With such feature, when a plurality of printing areas having the same length are repeatedly printed, the printing of one printing area can be necessarily finished in the printing with the ink ribbon other than the shorter ink ribbon.

According to a sixth aspect and feature of the present invention, there is provided a thermal transfer printer using a plurality of ink ribbons and designed to print a foundation or undercoat with an ink ribbon having a clear ink or a white ink, then print an image on the undercoat with an ink ribbon having an ink of a predetermined color, and further lap-print an overcoat on the image-formed area with an ink ribbon having a clear ink, at least one ink ribbon less influencing the printing accuracy being shorter in length than the other ink ribbons, the thermal transfer printer comprising a terminal end mark formed at a terminal end of the shorter ink ribbon, a detecting section for detecting the terminal end mark of the shorter ink ribbon, and a control section adapted to judge an ribbon end by the terminal end mark of the ink ribbon detected by the detecting section and to inform a user of the ribbon end.

With the above sixth feature, when the ribbon end of the at least one shorter ink ribbon is detected by the detecting section in the middle of the printing of one printing area, and the ribbon end is informed of, it is necessary to replace at least the at least one shorter ink ribbon. However, at the time point when the ribbon end has been informed of, the printing of such printing area has been finished, because the other ink ribbons are longer than the shorter ink ribbon, and hence, a joint cannot be produced in the printing with the longer ink ribbons.

According to a seventh aspect and feature of the present invention, in addition to the sixth feature, the ink ribbon less influencing the printing accuracy is shorter in length than the other ink ribbons by a length required for printing at least one printing area. With such feature, when a plurality of printing areas having the same length are repeatedly printed, the printing of one printing area can be necessarily finished in the printing with the ink ribbon other than the shorter ink ribbon.

According to an eighth aspect and feature of the present invention, in addition to the seventh feature, when the detecting section detects the terminal end mark of the shorter ink ribbon, the control section informs the user of the fact that all the ink ribbons have been delivered as if they have reached their ribbon ends. With such feature, a small portion of each of the longer ink ribbons is useless. However, the replacement of all the ink ribbons at this time point ensures that even in the subsequent printing, the ribbon ends cannot be revealed in the longer ink ribbons in the middle of the printing of one printing area.

According to a ninth aspect and feature of the present invention, in addition to the sixth or seventh feature, when the detecting section detects the terminal end mark of the shorter ink ribbon, the control section informs a user of the fact that all the ink ribbons have been delivered as if they have reached their ribbon ends, and all remaining portions of the ink ribbons are delivered until they reach the ribbon ends. With such feature, in a case of a multi-ribbon, the draw-out of head can be achieved automatically.

According to a tenth aspect and feature of the present invention, in addition to the ninth feature, if a certain ink ribbon still not reaching its ribbon end exists at the time when all the remaining portions of the ink ribbons have been delivered in a predetermined amount, the control section informs the user of the fact that a problem has been arisen in the situation of the certain ink ribbon. With such feature, it is possible to recognize that a problem such as breaking or winding failure has been arisen in the ink ribbon not reaching its ribbon end.

The above and other objects, features and advantages of the invention will become apparent from the following description of the preferred embodiment taken in conjunction with the accompanying drawings.

DETAILED DESCRIPTION OF THE PREFERRED EMBODIMENT

The present invention will now be described by way of an embodiment with reference to the accompanying drawings.

Figure 1:
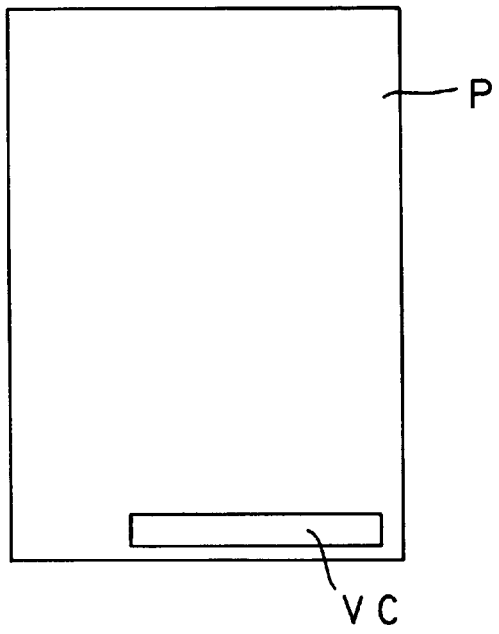
FIG. 1 is a plan view showing an embodiment of a voice code formed on a photograph by an ink ribbon assembly and a thermal transfer printer according to the present invention.

FIG. 1 shows a glossy photograph P as an image-receiving paper sheet in a state in which a voice code VC for reproducing a voice has been printed on a surface of the photograph P by a thermal transfer printer. The voice code VC is rectangular in entire shape and is formed of an assembly of fine dots. Thus, the voice is reproduced by placing the photograph P into a code reader and reading the voice code VC by the code reader.

Figure 2:
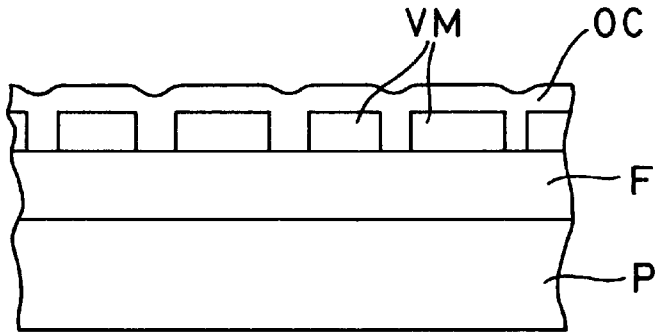
FIG. 2 is a vertical sectional view of an essential portion shown in FIG. 1.

The voice code VC is printed in a lengthwise direction by the thermal transfer printer. However, the photograph has a glossing coating applied on its surface and for this reason, the direct spread of ink on the surface is poor. Therefore, to print the voice code VC on the surface of the photograph P, a foundation or undercoat F is first printed with a clear or white ink FI in that entire area on the surface of the photograph P in which voice code mass VM is to be formed, as shown in FIG. 2. Then, the voice code mass VM is lap-printed on the undercoat F adapted for a good spread of ink with a predetermined color ink CI. Further, an overcoat OC is lap-printed with a clear ink TI on the voice code mass VM and the entire exposed area of the surface of the undercoat F in order to improve the sidability of the voice code mass VM. In this manner, the printing of the voice code VC is completed.

Figure 7:
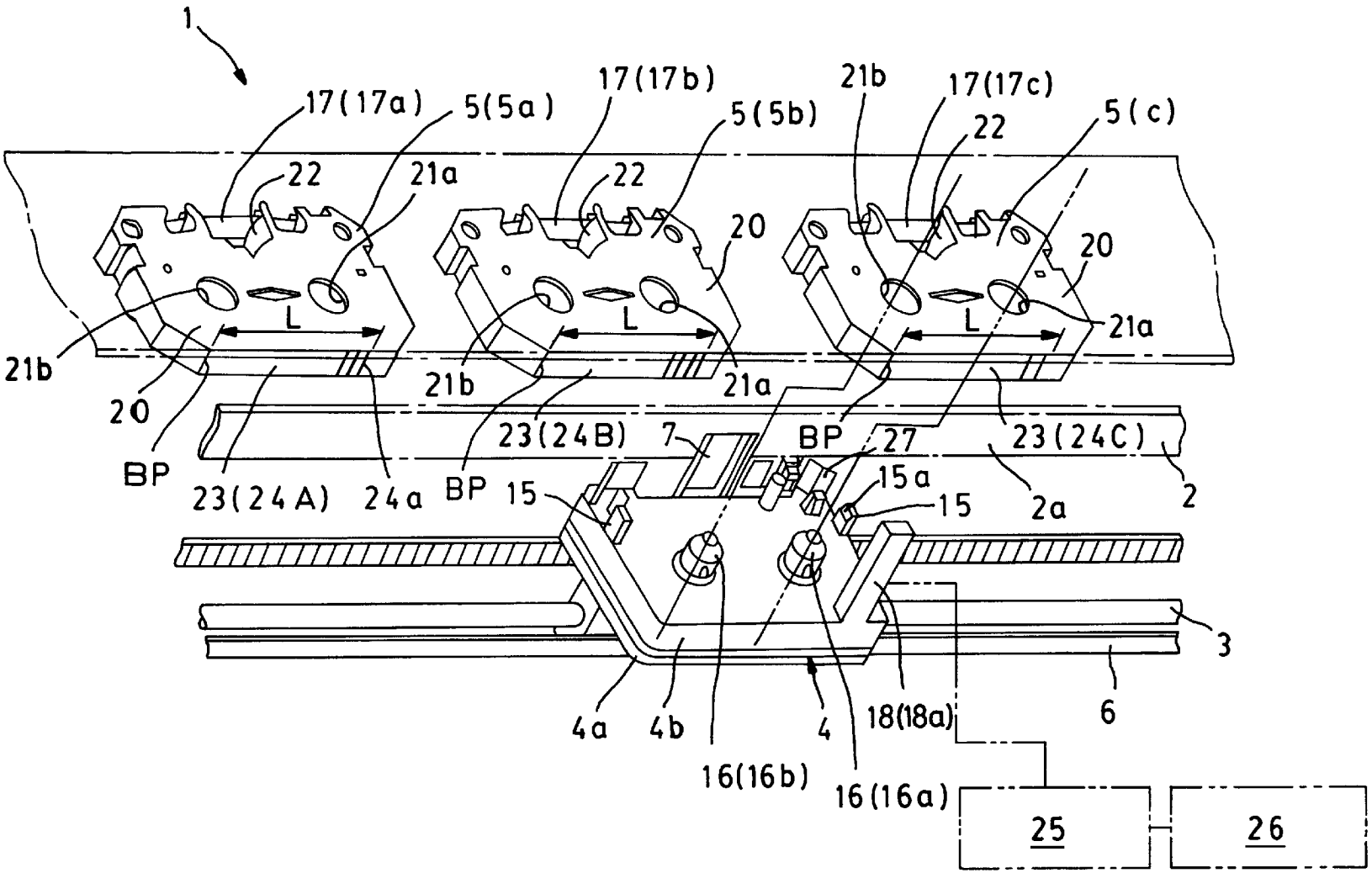
FIG. 7 is a perspective view of an essential portion of an embodiment of the thermal transfer printer according to the present invention.
Figure 8:
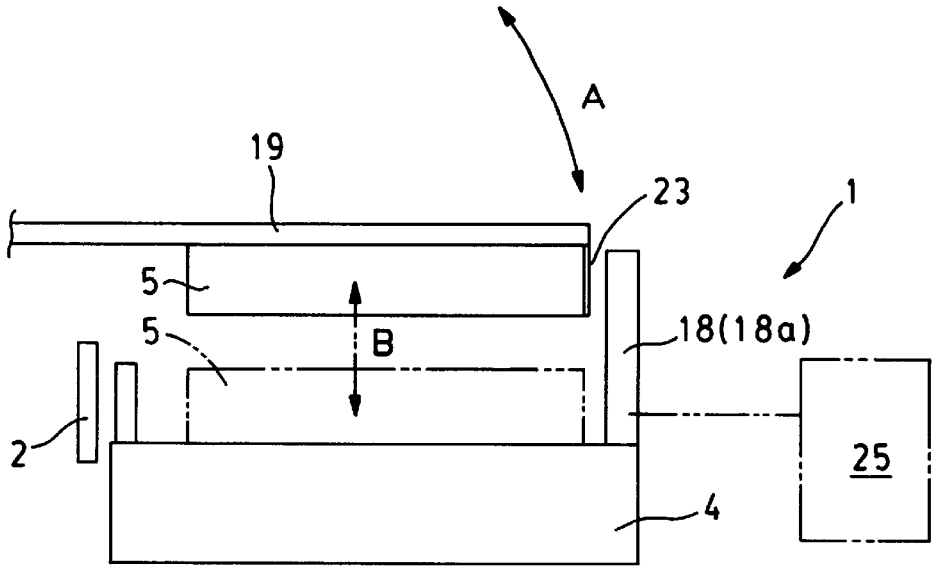
FIG. 8 is a side view showing the detail in the vicinity of a carriage.
Figure 9:
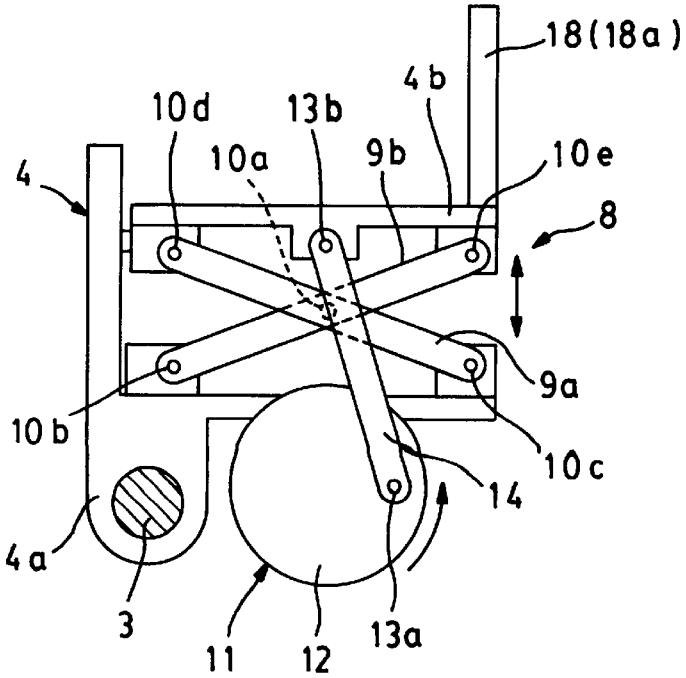
FIG. 9 is a side view showing the details of a parallel crank mechanism and a rotary crank mechanism.

An embodiment of the thermal transfer printer for carrying out such printing is shown in FIGS. 7 to 9.

A flat plate-like platen 2 is disposed on the thermal transfer printer 1 of the present embodiment at a desired location on a frame (not shown), so that its printing surface 2*a* is substantially vertical. A guide shaft 3 is disposed in parallel to the platen 2 in front of and below the platen 2. A carriage 4 divided vertically into two carriage sections is movably carried on the guide shaft 3. One 4*a* of the carriage sections shown on a lower side is referred to as a lower carriage section 4*a* carried on the guide shaft 3, and the other carriage section 4*b* shown on an upper side is referred to as an upper carriage section 4*b* to which a ribbon cassette 5 having an ink ribbon (which will be described hereinafter) accommodated therein is mounted, and which is movable vertically toward and away from the lower carriage section 4*a*.

The carriage 4 is adapted to be reciprocally driven along the guide shaft 3 by driving a suitable driving belt 6 reeved around a pair of pulleys (not shown) by a drive means (not shown) such as a stepping motor.

A thermal head 7 is disposed on the carriage 4 and adapted to be moved toward and away from a well-known head moving mechanism (not shown) which is opposed to the platen 2 and can be operated relative to the platen 2 by a driving force of a drive motor (not shown). The thermal head 7 is adapted to carry out the printing on the image receiving paper sheet transferred onto the platen 2 in a state of pressure contact with the platen 2 (i.e., in a head-down state). The thermal head 7 includes a plurality of heated elements (not shown) arranged in a row and selectively heated based on a desired printing information inputted by an input device (not shown) such as a keyboard.

The thermal head 7 is designed, so that the energizing energy is selectively controlled at 15 stages, i.e., the time of energization of each heated element is controlled at 15 stages by a control section 25 which will be described hereinafter.

The carriage 4 will be described in further detail. The carriage 4 is constructed such that the plate-like upper carriage section 4*b* substantially parallel to an upper surface of the lower carriage section 4*a* is mounted, so that it is moved in parallel toward and away from the lower carriage section 4*a* by a parallel crank mechanism 8. The parallel crank mechanism 8 is provided at each of laterally opposite ends of the carriage 4, as shown in FIG. 9, and includes a pair of rinks 9*a* and 9*b* crossing each other in an X-shape. The rinks 9*a* and 9*b* are pivoted at a location of crossing of them by a pin 10*a*, and slidably locked at their ends in elongated bores (not shown) defined left and right sides of the lower carriage section 4*a* and the upper carriage section 4*b* by pins 10*b*, 10*c*, 10*d* and 10*e*, respectively.

A rotary crank mechanism 11 is disposed on the lower carriage 4*a*, so that the upper carriage 4*b* is operated in parallel movement by the rotary crank mechanism 11. The rotary crank mechanism 11 is comprised of a rotating plate 12 constituting a rotating member rotatably supported on the lower carriage section 4*a*, and a connecting rink 14 constituting a connecting member which is pivoted in an eccentric position on the rotating plate 12 by a pin 13*a* and pivoted at its tip end on the upper carriage 4*b* by a pin 13*b*. Thus, the rotating plate 12 is rotated by a suitable drive means (not shown) such as a motor.

Returning to FIG. 7, plate-like arms 15 are provided in a risen manner at a distance approximately equal to the width of the ribbon cassette 5, and each have a tip end serving as an engage portions 15*a* which is curved gently inwards and which has projections formed at upper and lower ends thereof A pair of rotatable bobbins 16 are disposed at a distance spaced apart from each other at widthwise central portions of the upper carriage section 4*b* to protrude upwards, so that the ink ribbon 17 can be traveled in a predetermined direction by the bobbins 16. One of the bobbins 16 is a delivery bobbin 16*a* for delivering the ink ribbon 17, and the other bobbin 16 is a take-up bobbin 16*b* for taking-up the ink ribbon 17.

A photo-sensor 18*a* is disposed on an end edge of the carriage 4 farther from the plate 2 and serves as a sensor 18 for detecting the type of the ink ribbon 17 accommodated in the ribbon cassette 5. The photo-sensor 18 used in this embodiment is of a reflection type. The photo-sensor 18*a* is connected to the control section 25 for controlling the printing operation of the thermal transfer printer 1 disposed in the desired position.

As shown in FIGS. 7 and 8, a substantially plate-like canopy 19 is disposed above the carriage 4 and supported on a frame (not shown) so that it can be opened and closed in directions indicated by arrows A in FIG. 8. The canopy 19 functions as a paper sheet retainer at an outlet of a paper-sheet feed mechanism (not shown), and is disposed in an opposed relation to the carriage 4 and has a length substantially identical to a region of movement of the carriage 4.

A plurality of cassette holders (not shown) for holding the ribbon cassette 5 are mounted at predetermined locations on that lower surface of the canopy 19 which confronts the carriage 4 in parallel. The three ribbon cassettes 5 having three types of ink ribbons 17*a*, 17*b* and 17*c* individually accommodated therein are arranged in a row in a direction of movement of the carriage 4 by the cassette holder.

Figure 3:
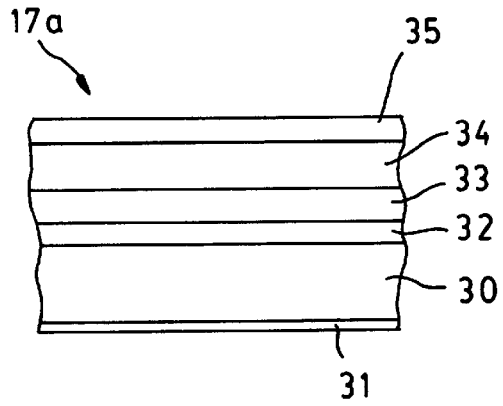
FIG. 3 is a vertical sectional view of an embodiment of an ink ribbon for printing a foundation or undercoat.

Among the ink ribbons 17*a*, 17*b* and 17*c*, the ink ribbon 17*a* is used to print the undercoat F as a lowermost layer less influencing the printing accuracy with a clear or white ink in that entire area on the surface of the photograph P described with reference to FIG. 2, in which voice code mass VM is to be formed. This ink ribbon 17*a* includes a substrate 30 formed of a PET film having a thickness of, for example, 4.5 $\mu$m, as shown in FIG. 3. A back layer 31 formed of a fluorine-based resin is laminated with a thickness of, for example, 0.3 $\mu$m on a back of the substrate 30 to come into direct contact with the thermal head 7 for preventing the adhesion of the thermal head 7 to the substrate 30 due to the heat of the thermal head 7 and improving the slidability between the thermal head 7 and the ink ribbon 17*a*.

On the other hand, a peel layer 32 formed of a resinous material is laminated with a thickness of, for example, 0.2 $\mu$m on a surface of the substrate 30 opposite from the back layer 31. An image-receiving layer 33 formed of a thermoplastic elastomer is laminated with a proper thickness on a surface of the peel layer 32 opposite from the substrate 30 for facilitating the spread of the voice code mass VM to be printed with the color ink CI. Further, a titania-containing white ink layer 34 having an effect of hiding a picture image of the photograph is laminated with a proper thickness on a surface of the image-receiving layer 33 opposite from the peel layer 32. Yet further, a adhesive layer 35 for good adhesion to the surface of the photograph P formed from a thermoplastic elastomer as a primary material and containing an anti-blocking agent such as wax, a higher aliphatic fatty acid amide, ester, a fluorine-based resin or the like, is laminated on a surface of the white ink layer 34 opposite from the image-receiving layer 33.

Figure 4:
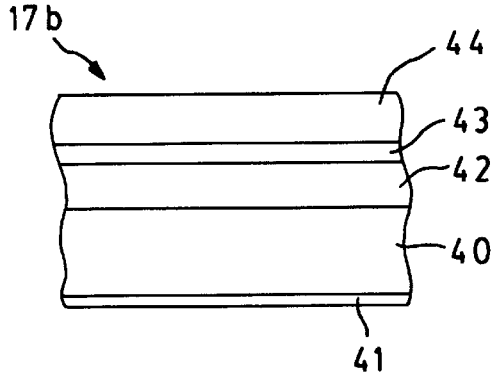
FIG. 4 is a vertical sectional view of an embodiment of an ink ribbon for printing a voice code mass.

The ink ribbon 17*b* is used to lap-print the voice code mass VM on the undercoat F. The ink ribbon 17*b* includes a substrate 40 formed of a PET film having a thickness of, for example, 2.5 $\mu$m, as shown in FIG. 4. A back layer 41 formed of a silicone-based material and having a function similar to that of the back layer 31 is laminated with a thickness of, for example, 0.25 $\mu$m on a back of the substrate 40.

On the other hand, a peel layer 42 formed of a wax material is laminated with a thickness of, for example, 1.0 $\mu$m on a surface of the substrate 40 opposite from the back layer 41. An intermediate layer 43 formed of a rosin-based tackifier for improving the spread of an over-coat OC (which will be described hereinafter) is laminated with a thickness of, for example, 0.3 $\mu$m on a surface of the peel layer 42 opposite from the substrate 40. Further, a coloring ink layer 44 formed of a resinous material for contributing to the formation of the voice code mass VM is laminated with a thickness of, for example, 1.2 $\mu$m on a surface of the intermediate layer 43 from the peel layer 42.

Figure 5:
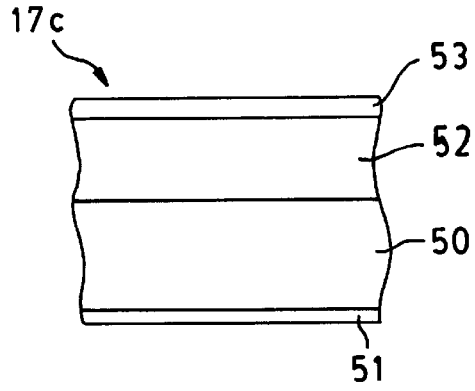
FIG. 5 is a vertical sectional view of an embodiment of an ink ribbon for printing an overcoat.

Further, the ink ribbon 17*c* is used to lap-print the overcoat OV less influencing the printing accuracy on the exposed areas of the undercoat F and on the voice code mass VM. The ink ribbon 17*c* includes a substrate 50 formed of a PET film having a thickness of, for example, 4.5 μm, as shown in FIG. 5. A back layer 51 formed of a fluorine-based resin and having a function similar to that of each of the back layers 31 and 41 is laminated with a proper thickness on a back of the substrate 50.

On the other hand, a clear ink layer 52 formed of a resinous material is laminated with a proper thickness on a surface of the substrate 50 opposite from the back layer 51. An adhesive layer 52 formed of a material similar to that of the adhesive layer 35 for improving the adhesion to the undercoat F and the voice code mass VM is laminated on a surface of the clear ink layer 52 opposite from the substrate 50.

Figure 6:
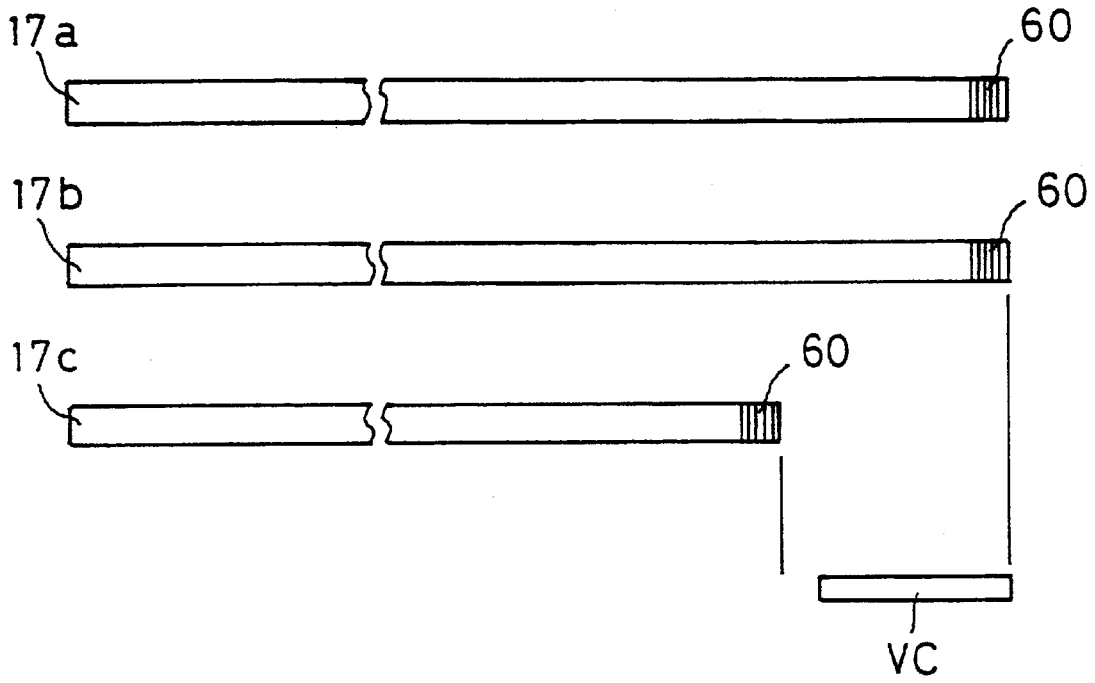
FIG. 6 is a plan view showing the relationship between the lengths of the ink ribbons.

In the present embodiment, the length of the ink ribbon 17*c* used to print the overcoat OC forming the uppermost layer is shorter than the length of the ink ribbons 17*a* and 17*b* used for the other printing, as shown in FIG. 6. A difference between the length of the ink ribbon 17*c* and the length of the ink ribbons 17*a* and 17*b* is a lengthwise length of the voice code VC which is at least one area to be printed. When there is a possibility that the printing of two or more voice code masses having different lengths is carried out, the difference between the length of the ink ribbon 17*c* and the length of the ink ribbons 17*a* and 17*b* is equal to or larger than a lengthwise length of one of the longest voice code masses. Unlike in FIG. 6, the length of the ink ribbon 17*a* used to print the undercoat F forming the lowermost layer less influencing the printing accuracy may be shorter than the length of the ink ribbons 17*b* and 17*c* used for the other printing.

Further, a stripe-like terminal end mark 60 is formed at a terminal end of each ink ribbon 17 and used to detect the end of each ink ribbon 17.

Returning to FIG. 7, a photo-sensor 27 is disposed sideways of the thermal head 7 of the lower carriage section 4*a* of the carriage 4 and serves as a detecting means opposed to an opening (not shown) of the ribbon cassette 5 mounted on the upper carriage section 4*b* for detecting the terminal end mark 60 of the ink ribbon 17. The photo-sensor 27 is connected to the control section 25 for the thermal transfer printer, so that when the photo-sensor 27 has detected the terminal end mark 60 of the ink ribbon 17 accommodated in the ribbon cassette 5, a detection signal is outputted to the control section 25. The control section 25 is provided with a informing section 26 for informing a user of the ribbon end by display or by voice upon inputting of the detection signal from the photo-sensor 27.

The lengths of the ink ribbons 17*a*, 17*b* and 17*c* accommodated in the ribbon cassettes 5, respectively, are set such that the ink ribbon 17*c* used to print the uppermost layer is shorter than the other ink ribbons 17*a* and 17*b*, as described above. However, if three ribbon cassettes 5 are simultaneously started to be used, the undercoat F, the voice code mass VM and the overcoat OC are used through equal length thereof in order to print the voice code VC. Therefore, the terminal end mark 60 of the shorter ink ribbon 17*c* is first detected by the photo-sensor 27. At this time, the control section 25 ensures that the informing section 26 associated with informs the user of the fact that not only the end of the ink ribbon 17*c* but also the ends of the other two ink ribbons 17*a* and 17*b* actually not detected have been detected.

This is for the purpose of ensuring that when the ribbon end of the uppermost ink ribbon 17*c* is detected, all of the ribbon cassettes 5 are simultaneously replaced by new ones, because in the printing of the voice code mass VM, if the replacement of the ink ribbons 17*a* and 17*b* is carried out during of printing of one voice code VC, gaps or joints such as overlapped portions are produced in the printing using new ink ribbons 17*a* and 17*b* replacing the old ink ribbons 17*a* and 17*b*, thereby bringing about a disadvantage in the formed voice code VC, whereas in the uppermost overcoat OC, no particular adverse influence is produced even if gaps or overlapped portions are produced in the printing.

Each of the ribbon cassettes 5 is selectively delivered between the canopy 9 and the upper carriage section 4*b* by movement of the parallel crank mechanism 8 operated in operative association with the rotary crank mechanism 11, as shown by arrows B in FIG. 8.

The ribbon cassettes 5 in the present embodiment are all formed into the same shape and the same size, irrespective of the type of the ink ribbon 17. Disposed in a pair of upper and lower case bodies 20 substantially rectangular in plane are a pair of reels supported rotatably, a pair of ribbon delivery rollers supported rotatably, and a plurality of guide rollers supported rotatably to face a ribbon path, which are not shown.

The ink ribbon 17 is reeved between the pair of reels, with an intermediate portion of the ink ribbon 17 being drawn to the outside. The pair of reels are operated, so that when the ribbon cassette 5 has been loaded onto the upper carriage section 4*b*, one of the reels acts as a take-up reel for taking-up a portion of the ink ribbon 17 placed into the printing, and the other reel acts as a delivery reel for delivering the ink ribbon. Each of the reels has a plurality of key grooves defined into a spline-like configuration in its inner peripheral surface at distances circumferentially spaced apart from one another. A take-up bore 21*b* is defined in the inner peripheral surface of the take-up reel, so that the take-up bobbin is engaged into the take-up bore 21*b*, and a delivery bore 21*a* is defined in the inner peripheral surface of the delivery reel, so that the delivery bobbin is engaged into the delivery bore 21*a*.

A recess 22 facing outwards with respect to the thermal head 7 is defined in that face of the ribbon cassette 5 which is opposed to the platen 2 in a state in which the ribbon cassette 5 has been loaded on the carriage 4. The intermediate portion of the ink ribbon 17 is drawn out within the recess 22.

Further, a discriminating mark 23 for determining the type of the ink ribbon 17 accommodated within each cassette 5 is applied to that rear face of the ribbon cassette 5 which extends in parallel to the face of the ribbon cassette 5 having the recess 22 defined therein. In the present embodiment, the discriminating mark 23 is formed by a reflection seal 24 having a number of stripe-shaped non-reflective portions 24*a*, which is varied depending on the type of the ink ribbon 17.

Thus, the type of the ink ribbon 17*a*, 17*b*, 17*c* accommodated in the ribbon cassette 5 is determined by detecting the discriminating mark 23 by the photo-sensor 18*a* mounted on the carriage 4, outputting a detection signal to the control section 25 for the thermal transfer printer 1, and counting the number of the discriminating marks 23 in each ribbon cassette 5 in the control section 25.

More specifically, a reflection seal 24A having three non-reflective portions 24*a* are disposed as discriminating marks in the ribbon cassette 5*a* shown on the leftmost side in FIG. 7. The left end of the rear face, shown this side in FIG. 7, of the ribbon cassette 5 is defined as a reference position BP for detecting the discriminating mark 23. The distance L from the reference position to a right end face of the non-reflective portion 24*a* located at the right end in FIG. 7 of the discriminating mark 23 is set at the same value in all of the discriminating marks 23, and the desired non-reflective portions 24*a* for discriminating the type of the ink ribbon 17*a* are formed within the distance L. The carriage 4 can be stopped in a state in which the discriminating mark 23 placed into use has been detected by the photo-sensor 18*a*, and when the carriage 4 is in its stopped state, the ribbon cassette 5 accommodated in the cassette holder is delivered onto the upper carriage section 4*b*.

The control section 25 is designed to carry out the control such that, after the informing section 26 informs the user of the fact that when the end of the shorter ink ribbon 17*c* has been detected, the ends of the two other ink ribbons 17*a* and 17*b* actually not detected has been also detected, the ribbon cassettes 5*a* and 5*b* having the two other ink ribbons 17*a* and 17*b* accommodated therein are sequentially loaded onto the carriages 4, and the ink ribbons 17*a* and 17 are delivered, until the ribbon ends have been revealed. This is to ensure that even when each ink ribbon 17 is a so-called multi-ribbon, the drawn-out of head can be achieved automatically. In addition, the control section 25 is designed to ensure that when the terminal end marks 60 of the ink ribbons 17*a* and 17*b* cannot be detected even if the ink ribbons 17*a* and 17*b* has been delivered in a predetermined amount until they has reached the ribbon ends, the informing section 26 informs the user of the fact that there is a problem arisen in the situations of the ink ribbons 17*a* and 17*b*. This is because it can be recognized that there is a problem such as a breaking or a winding failure arisen in the ink ribbons 17*a* and 17*b* which has not reached their ribbon ends.

The operation of the present embodiment having the above-described arrangement will be described below.

In the thermal transfer printer in the present invention, the ribbon cassettes 5*a*, 5*b* and 5*c* having the three types of ink ribbons 17*a*, 17*b* and 17*c* are accommodated respectively therein are new ones by which the old ribbon cassettes have been replaced simultaneously. When information about the voice code printed by a host computer or the like is transmitted to the control section 25, the carriage 4 located in a home position is moved by a command from the control section 25, and the photo-sensor 18*a* disposed on the carriage 4 detects the discriminating mark 23 on the ribbon cassette 5. Then, the photo-sensor 18*a* delivers a detection signal peculiar to the discriminating mark 23 formed by the arrangement and pitches of the non-reflective portions 24*a* to the control section 25. It is determined in the control section 25 whether the detection signal represents the discriminating mark 23 corresponding to the command emitted in the control section 25. When the detection signal represents the discriminating mark 23 corresponding to the command, the movement of the carriage 4 is stopped. In the present embodiment, the foundation or undercoat F, the voice code mass VM and the overcoat OC are printed in the named order and hence, the ribbon cassette 5*a* having the ink ribbon 17*a* accommodated therein for the undercoat F is first discriminated.

Then, the ribbon cassette 5 with the selected ink ribbon 17*a* accommodated therein for the undercoat is selectively delivered from the canopy 19 to the upper carriage section 4*b*, as shown by the arrows B in FIG. 8, by the parallel crank mechanism 8 and the rotary crank mechanism 11, and the ribbon cassette 5*a* is set onto the carriage 4, thus completing the operation of selecting the ribbon cassette 5*a*.

Then, the photograph P on which the voice code is to be printed is set between the platen 2 and the thermal head 7 by an operator or by a feed device (not shown), whereby the printing of the undercoat F is started. The thermal head 7 is moved downwards by the command from the control section 25 to come into pressure contact with the platen 2 with the ink ribbon 17*a* and the photograph P interposed therebetween, and the carriage 4 is moved. When the heated elements of the thermal head 7 corresponding to that entire area on the surface of the photograph P in which voice code mass VM are to be formed, are heated, while moving the thermal head 7 relative to the photograph P in the above manner, the thermoplastic elastomer of the image-receiving layer 33 and the while ink of the white ink layer 34 on the ink ribbon 17*a* are peeled off from the peel layer 32 and transferred onto the photograph P.

When the printing of the undercoat F has been completed in the above manner, the ribbon cassette 5*a* used in the printing of the undercoat F is delivered from the upper carriage section 4*b* to the canopy 19 by an operation reverse from that described above. Then, the ribbon cassette 5*b* with the ink ribbon 17*b* accommodated therein for use in the printing of the voice code mass VM is discriminated and delivered from the canopy 19 to the upper carriage section 4*b*, whereby the printing of the voice code mass VM is started.

More specifically, the thermal head 7 is moved downwards into pressure contact with the platen 2 with the ink ribbon 17*b* and the photograph P interposed therebetween by the command from the control section 25, and the carriage 4 is moved. When the heated elements of the thermal head 7 corresponding to the voice code mass VM are heated, while moving the thermal head 7 relative to the photograph P in the above manner, the rosin-based tackifier of the intermediate layer 43 and the ink of the coloring ink layer 44 on the ink ribbon 17*b* are peeled off from the peel layer 42 and transferred onto the photograph P, thus completing the printing of the voice code mass VM which is the assembly of dots corresponding to voice.

When the printing of the voice code mass VM has been completed in the above manner, the ribbon cassette 5*b* used in the printing of the voice code mass VM is delivered from the upper carriage section 4*b* to the canopy 19 by an operation reverse from that described above. Then, the ribbon cassette 5*c* with the ink ribbon 17*c* accommodated therein for use in the printing of the overcoat OC is discriminated and delivered from the canopy 19 to the upper carriage section 4*b*, whereby the printing of the overcoat OC is started.

More specifically, the thermal head 7 is moved downwards into pressure contact with the platen 2 with the ink ribbon 17*b* and the photograph P interposed therebetween by the command from the control section 25, and the carriage 4 is moved. When the heated elements of the thermal head 7 corresponding to the voice code mass VM and the exposed entire area of the undercoat F are heated, while moving the thermal head 7 relative to the photograph P in the above manner, the clear ink of the clear ink layer 52 and the adhesive essentially comprising the thermoplastic elastomer of the adhesive layer 53 are peeled off from the substrate 50 and transferred onto the photograph P, thus completing the printing of the overcoat OC for improving the slidability of the voice code mass VM.

When the printing of one voice code VC has been completed in the above manner, the operation is shifted to the printing of the subsequent voice code. For this purpose, the ribbon cassette 5*c* for the overcoat OC loaded on the carriage 4 is replaced by the ribbon cassette 5*a* for the printing of the undercoat F, whereby the printing of the undercoat F is carried out again, followed by the printings of the voice code mass VM and the overcoat OC.

When the printing of the voice code VC comprising the undercoat F, the voice code mass VM and the overcoat OC is repeated, the ink ribbon 17 accommodated in the ribbon cassette 5 is gradually consumed.

The lengths of the ink ribbons 17 accommodated in the ribbon cassettes 5 are set such that the ink ribbon 17*c* for the overcoat OC which is the uppermost layer is shorter than the other ink ribbons 17*a* and 17*b* at least by the length of the voice code VC. Therefore, the photo-sensor 27 first detects the terminal end mark 60 of the ink ribbon 17*c* for the overcoat OC.

Then, the control section 25 ensures that it is determined that not only the end of the ink ribbon 17*c* actually detected but also the ends of the two other ink ribbons 17*a* and 17*b* actually not detected have been detected, and the informing section 26 informs the user of this fact. Then, the control section 25 carries out such control that the ink ribbons 5*a* and 5*b* with the two other ink ribbons 17*a* and 17*b* accommodated therein are sequentially loaded onto the carriage 4, and the ink ribbons 17*a* and 17*b* are delivered until their ends are revealed.

At this time point, the operator replaces all the ribbon cassettes 5 simultaneously by new ones. This is because in the printing of the voice code mass VM, if the replacement of the ink ribbons 17*a* and 17*b* is carried out during of printing of one voice code VC, gaps or joints such as overlapped portions are produced in the printing using new ink ribbons 17*a* and 17*b* replacing the old ink ribbons 17*a* and 17*b*, thereby bringing about a disadvantage in the formed voice code VC, whereas in the uppermost overcoat OC, no particular adverse influence is produced even if gaps or overlapped portions are produced in the printing.

Even when gaps or joints such as overlapped portions are produced in the printing of the lowermost undercoat F, unlike in the present invention, no large adverse influence is produced. In other words, even if overlapped portions are produced in the printing of the undercoat F, no influence is exerted to the printing of the voice code VC. On the other hand, even if gaps are produced in the printing of the undercoat F, the printing of the voice code VC is feasible.

Further, when the joints produced in the printing of the undercoat F are compared with the joints produced in the printing of the overcoat OC, all the joints are of a level free of any problem, but the joints produced in the printing of the overcoat OC provides a less influence.

As discussed above, with the thermal transfer printer according to the present embodiment, the printing of the overcoat OC with the ink ribbon 17*c* in one voice code VC may be carried out twice by replacing the ribbon cassettes 5*c* by new one. This is free of any problem, because even if gaps or joints such as overlapped portions are produced in the overcoat OC, they exert no adverse influence.

On the other hand, at the time point when the terminal end mark 60 of the ink ribbon 17*c* accommodated in the ribbon cassette 5*c* for the overcoat OC is detected, the ends marks of the other ink ribbons 17*a* and 17*b* accommodated in the ribbon cassettes 5*a* and 5*b* for carrying out the printing of the undercoat F and the voice code mass VM are still not detected and thus, unused areas remain in these ink ribbons 17*a* and 17*b*. Nevertheless, when the ribbon cassette 5*c* is replaced by new one, the ribbon cassettes 5*a* and 5*b* are also replaced simultaneously with the ribbon cassette 5*c* by new ones. Therefore, in the subsequent printing, the end detection of the ink ribbons 17*a* and 17*c* cannot be performed, before the end detection of the ink ribbon 17*c* is performed. Thus, in the printing of the voice code mass VM in which if gaps or lapped portions are produced, a disadvantage is arisen in the formed voice code VC, the voice code mass VM is formed by one run of the printing and hence, it is possible to form the voice code having a good reproducibility.

Although the embodiment of the present invention has been described in detail, it will be understood that the present invention is not limited to the above-described embodiment, and various modifications and variations may be made without departing from the spirit and scope of the invention defined in claims. For example, the terminal end marks have been formed on all the ink ribbons in the embodiment, but a terminal end mark may be formed in only the ink ribbon for use in the printing of the uppermost layer.

In addition, the ink ribbon less influencing the printing accuracy, e.g., the ink ribbon for use on the printing of the lowermost layer may be shorter in length than the other ink ribbons.

Further, the two or more ink ribbons such as the ink ribbon for use in the printing of the uppermost layer and the ink ribbon for use in the printing of the lowermost layer may be shorter in length than the other ink ribbon. In this case, the length of the ink ribbon to be discarded may be further shorter.

What is claimed is:

1. An ink ribbon assembly for use in a thermal transfer printer, which comprises a plurality of ink ribbons, so that lap-printings are carried out using the ink ribbons in a predetermined order, wherein at least one ink ribbon which has less influence on an outcome of the printing accuracy is shorter in length than the other ink ribbons, said shorter ink ribbon having a terminal end mark formed at its terminal end.

2. An ink ribbon assembly according to claim 1, wherein said-shorter ink ribbon is an ink ribbon for use in the printing of an uppermost layer.

3. An ink ribbon assembly according to claim 2, wherein said ink ribbon for use in the printing of the uppermost layer is an ink ribbon for an overcoat having a clear ink.

4. An ink ribbon assembly according to claim 1, wherein said shorter ink ribbon is an ink ribbon for use in the printing of a lowermost layer.

5. An ink ribbon assembly according to any of claims 1 to 4, wherein said shorter ink ribbon is shorter in length than the other ink ribbons by a length required to print at least one printing area.

6. A thermal transfer printer using a plurality of ink ribbons and designed to print a foundation or undercoat with an ink ribbon having a clear ink or a white ink, then print an image on the undercoat with an ink ribbon having an ink of a predetermined color, and further lap-print an overcoat on the image-formed area with an ink ribbon having a clear ink, at least one ink ribbon which has less influence on an outcome of the printing accuracy being shorter in length than the other ink ribbons, said thermal transfer printer comprising a terminal end mark formed at a terminal end of said shorter ink ribbon, a detecting section for detecting said terminal end mark of said shorter ink ribbon, and a control section adapted to judge a ribbon end by said terminal end mark of the ink ribbon detected by said detecting section and to inform a user of said ribbon end.

7. A thermal transfer printer according to claim 6, wherein said shorter ink ribbon is shorter in length than the other ink ribbons by a length required for printing at least one printing area.

8. A thermal transfer printer according to claim 6 or 7, wherein when said detecting section detects said terminal end mark of said shorter ink ribbon, said control section informs a user of the fact that all the ink ribbons have been delivered as if they have reached their ribbon ends.

9. A thermal transfer printer according to claim 6, wherein when said detecting section detects said terminal end mark of said shorter ink ribbon, said control section informs a user of the fact that all the ink ribbons have been delivered as if they have reached their ribbon ends, and all remaining portions of the ink ribbons are delivered until they reach the ribbon ends.

10. A thermal transfer printer according to claim 7, wherein when said detecting section detects the tenmiaal end mark of said shorter ink ribbon, said control section informs a user of the fact that all the ink ribbons have been delivered as if they have reached their ribbon ends, and all remaining portions of the ink ribbons are delivered until they reach the ribbon ends.

11. A thermal transfer printer according to claim 9 or 10, wherein when a certain ink ribbon still not reaching its ribbon end exists at the time when all the remaining portions of the ink ribbons have been delivered in a predetermined amount, said control section informs the user of the fact that a problem has been arisen in the situation of said certain ink ribbon.

* * * * *